US009052637B2

(12) United States Patent
Taniguchi

(10) Patent No.: US 9,052,637 B2
(45) Date of Patent: Jun. 9, 2015

(54) TONER SUPPLY DEVICE AND IMAGE FORMING APPARATUS

(71) Applicant: CANON KABUSHIKI KAISHA, Tokyo (JP)

(72) Inventor: Koichi Taniguchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/938,316

(22) Filed: Jul. 10, 2013

(65) Prior Publication Data

US 2014/0044442 A1 Feb. 13, 2014

(30) Foreign Application Priority Data

Aug. 10, 2012 (JP) ..... 2012-178757
Aug. 30, 2012 (JP) ..... 2012-189715

(51) Int. Cl.
*G03G 15/08* (2006.01)

(52) U.S. Cl.
CPC ..... *G03G 15/0856* (2013.01); *G03G 15/0872* (2013.01)

(58) Field of Classification Search
CPC ..... G03G 15/0856; G03G 15/0872
USPC ..... 399/27, 36, 78, 258
See application file for complete search history.

(56) References Cited

U.S. PATENT DOCUMENTS

2006/0104650 A1* 5/2006 Matsunai ..... 399/27
2011/0097094 A1* 4/2011 Hamano et al. ..... 399/27
2011/0158669 A1* 6/2011 Kayahara ..... 399/53
2012/0020683 A1* 1/2012 Miura et al. ..... 399/27
2012/0195611 A1 8/2012 Adachi et al.
2012/0237227 A1 9/2012 Takane et al.
2013/0202319 A1* 8/2013 Komatsu et al. ..... 399/27

FOREIGN PATENT DOCUMENTS

EP 2491461 A1 8/2012
JP 2001-066869 A 3/2001
JP 2001-134066 A 5/2001
JP 2001-166578 A 6/2001
JP 2005-241675 A 9/2005
JP 2005-316034 A 11/2005
JP 2007-108631 A 4/2007
JP 3960980 B2 8/2007
JP 4060998 B2 3/2008
JP 2008-077028 A 4/2008
JP 2008-107813 A 5/2008
JP 2009-092739 A 4/2009
JP 2009-092753 A 4/2009

(Continued)

*Primary Examiner* — Rodney Bonnette
(74) *Attorney, Agent, or Firm* — Fitzpatrick, Cella, Harper & Scinto

(57) ABSTRACT

A toner supply device includes a toner cartridge, a cartridge driving source, a toner detection sensor, a conveyance member which conveys toner, and a rotating member driving source which drives the conveyance member. In addition, a driving controller controls the rotating member driving source, and a controller controls a series of replenishment operations of the toner cartridge based on a detection result of the toner detection sensor. The series of replenishment operations of the toner cartridge is controlled based on information about driving of the conveyance member, which is acquired at every predetermined period after starting the series of replenishment operations.

11 Claims, 21 Drawing Sheets

(56) References Cited

FOREIGN PATENT DOCUMENTS

| | | | |
|---|---|---|---|
| JP | 2009-103906 | A | 5/2009 |
| JP | 2009-251152 | A | 10/2009 |
| JP | 2010-113030 | A | 5/2010 |
| JP | 2010-243766 | A | 10/2010 |
| JP | 2011-150308 | A | 8/2011 |
| JP | 2011-227202 | A | 11/2011 |
| JP | 2011-232472 | A | 11/2011 |
| JP | 2011-237834 | A | 11/2011 |
| JP | 2012-063799 | A | 3/2012 |
| JP | 2012-083645 | A | 4/2012 |
| JP | 4916039 | B2 | 4/2012 |
| JP | 4926484 | B2 | 5/2012 |
| JP | 2012-185524 | A | 9/2012 |
| JP | 2012-194379 | A | 10/2012 |
| JP | 5038522 | B2 | 10/2012 |
| WO | 2011049219 | A1 | 4/2011 |

* cited by examiner

*FIG. 19*

$$T_n = T_{n-1} + \int \{G(N - A)\}$$

T: DUTY
G: FEEDBACK GAIN (1 IN PRESENT EMBODIMENT)
N: EXECUTION COUNT
A: THRESHOLD VALUE (2 IN PRESENT EMBODIMENT)

TONER SUPPLY DEVICE AND IMAGE FORMING APPARATUS

BACKGROUND OF THE INVENTION

1. Field of the Invention

The present invention relates to an image forming apparatus such as a copying machine, a printer, and a printing machine, and in particular, to an image forming apparatus including a toner supply device which is configured to supply powder such as toner.

2. Description of the Related Art

Conventionally, there is a toner cartridge which discharges toner by rotating a container which contains toner. For example, there is known that a magnetic sensor is provided to control a rotation number based on a detected remaining toner amount (see, for example, Japanese Patent Laid-Open No. 2009-092753). On the other hand, the toner discharge characteristics of a toner cartridge are measured in advance in order to reduce costs involved in a sensor (see, for example, Japanese Patent Laid-Open No. 2001-166578). In Japanese Patent Laid-Open No. 2001-166578, based on the measurement results of toner discharge characteristics, an operation time and a rotation number are controlled such that a constant amount of toner is discharged.

However, in the conventional toner cartridge driving control, there is a case where replenishment control capable of sufficiently satisfying a higher level of requirement is impossible.

Therefore, it is desirable to provide toner cartridge replenishment control which can satisfy a higher level of requirement.

SUMMARY OF THE INVENTION

Therefore, a representative configuration of a toner supply device according to the present invention includes: a toner cartridge which contains toner; a toner storage portion which is configured to store the toner supplied from the toner cartridge; a toner detection sensor which is configured to detect the toner in the toner storage portion; a conveyance member which conveys the toner in the toner storage portion; a cartridge driving source which rotation-drives the toner cartridge; and a controller which controls a series of replenishment operations of the toner cartridge based on a detection result of the toner detection sensor; wherein the controller controls whether to continue a series of replenishment operations of the toner cartridge based on information about driving of the conveyance member which is acquired at every predetermined period after the starting of the series of replenishment operations of the toner cartridge.

Further features of the present invention will become apparent from the following description of exemplary embodiments with reference to the attached drawings.

BRIEF DESCRIPTION OF THE DRAWINGS

FIG. 19 is a view illustrating an equation for calculating a rotation number in Step C of the third embodiment.

DESCRIPTION OF THE EMBODIMENTS

First Embodiment

Figure 1:
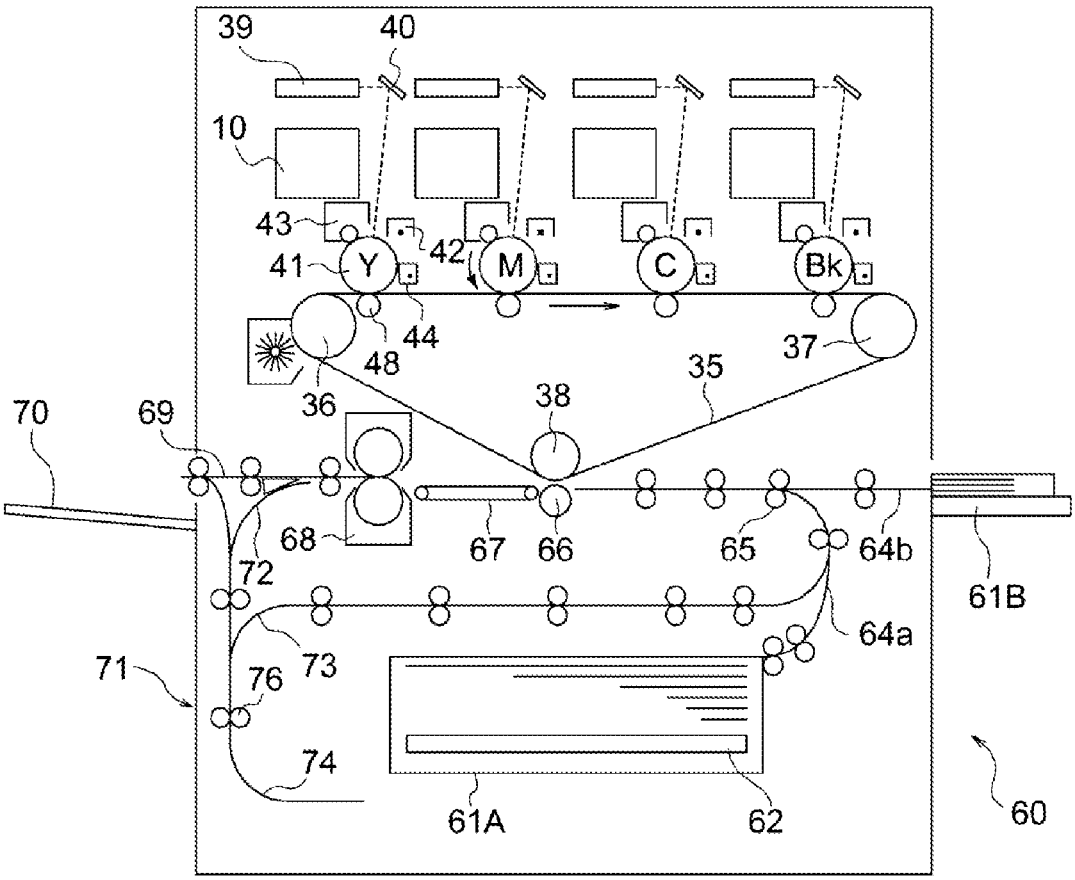
FIG. 1 is a schematic cross-sectional view of an image forming apparatus.

<Image Forming Apparatus> An image forming apparatus according to the present invention will be described. First, a configuration and operation of the image forming apparatus will be described with reference to FIG. 1. FIG. 1 is a schematic cross-sectional view of the image forming apparatus.

The image forming apparatus may use a plurality of systems such as an electrophotographic system, an offset printing system, and an ink jet system. In the present embodiment, an image forming apparatus 60 is a color image forming apparatus which uses an electrophotographic system. The image forming apparatus 60 is a so-called intermediate transfer tandem image forming apparatus in which four colors of image forming portions are aligned on an intermediate transfer belt.

A sheet material S is loaded into a sheet feeding portion 61 (sheet material repository 61A or sheet tray 61B). A lift-up unit is disposed in the sheet material repository 61A.

The sheet material S is fed in accordance with image formation timing. Herein, the sheet feeding portion 61 performs frictional separation of the sheet material S by a separation roller. The sheet material S discharged by the sheet feeding portion 61 is conveyed through a conveyance path 64 (conveyance path 64*a* or conveyance path 64*b*) to a registration roller 65.

The registration roller 65 is a unit for matching the relative positions of the sheet material S and an image. The registration roller 65 performs skew correction and timing correction on the sheet material S prior to conveyance to a secondary transfer portion.

The secondary transfer portion is a toner image transfer nip portion to the sheet material S, which is formed by a secondary transfer inside roller 38 and a secondary transfer outside roller 66 which face each other. The secondary transfer portion adsorbs a toner image on the sheet material S by applying a predetermined pressure and an electrostatic load bias.

<Image Forming Process> With respect to the above-described process of conveying the sheet material S to the secondary transfer portion, a process of forming an image transferred to the secondary transfer portion at the same timing will be described. Also, in the following description, four sets of yellow (Y), magenta (M), cyan (C), and black (Bk) image forming portions are present as illustrated in FIG. 1. Since the respective image forming portions have the same configuration, suffixes of Y, M, C, and Bk will be omitted unless necessary.

The image forming portion mainly includes a photosensitive drum 41 (image bearing member), a charge unit 42, an exposure unit 39, a development device 43, a primary transfer unit 48, and a drum cleaner 44.

By this configuration, first, the surface of the photosensitive drum 41 is uniformly charged by the charge unit 42. Next, based on a signal of image information, the exposure unit 39 is driven with respect to the photosensitive drum 41 which rotates in the direction of an arrow in the drawing. Laser exits from the exposure unit 39. The laser arrives on the photosensitive drum 41 appropriately through a diffraction member 40, and an electrostatic latent image is formed thereon. The electrostatic latent image formed on the photosensitive drum 41 is actualized as a toner image of each color on the photosensitive drum 41 through toner development by the development device 43.

Thereafter, a predetermined pressure and an electrostatic load bias are applied by the primary transfer unit 48, and a toner image is transferred on an intermediate transfer belt 35. Thereafter, a little residual transfer toner left on the photosensitive drum 41 is recovered by the drum cleaner 44, to prepare for next image formation again.

Next, the intermediate transfer belt 35 will be described. The intermediate transfer belt 35 is stretched by rollers such as a drive roller 36, a tension roller, and a secondary transfer inside roller 38, and is conveyance-driven in the direction of an arrow B in the drawing.

The above-described respective color image forming processes by the respective Y, M, C, and Bk image forming portions are performed in parallel. Then, the toner image of each color is superimposed on the toner image of upstream color which has been primarily-transferred on the intermediate transfer belt 35. As a result, finally, a full-color toner image is formed on the intermediate transfer belt 35 and is conveyed to the secondary transfer portion.

<Process after Secondary Transfer> Through the sheet material S conveyance process and the image forming process described above, a full-color toner image is transferred on the sheet material S in the secondary transfer portion.

Thereafter, the sheet material S is conveyed to a fixing unit 68 by a pre-fixing conveying portion 67. The fixing unit 68 fuses and fixes a toner image on the sheet material S by applying a predetermined pressure by facing rollers or belts and a heating effect by a heat source such as a heater.

The sheet material S including the fixed image, which is obtained in this way, is discharged on a discharge tray 70. In this discharge process, whether or not the sheet material S passes through a discharge conveyance path 69, or when duplex image formation is necessary, whether or not the sheet material S passes through a reverse induction path 72 included in a reverse conveying apparatus 71, is selected.

When duplex image formation is necessary, the sheet material S is drawn from the reverse induction path 72 into a switchback path 74. Then, by replacing a front edge and a rear edge by performing forward and reverse rotation of a reversing roller 76 (switchback operation), the sheet material S is reconveyed through a duplex conveying path 73 to the image forming portion.

<Configuration of Toner Supply Device> As illustrated in FIG. 1, a toner supply device 10 is attached to a rear upper portion of an apparatus body. The toner supply device 10 supplies toner to the development device 43, and replenishes toner from a toner cartridge 14 (see FIG. 2) into a toner supply body 10*a* of the toner supply device 10. A function for supplying toner to the development device 43 is an example of the function of the toner supply device 10 in the image forming apparatus body. Therefore, the toner supply device 10 is disposed on top of the development device 43 in order to be able to supply toner to the development device 43.

Figure 2:
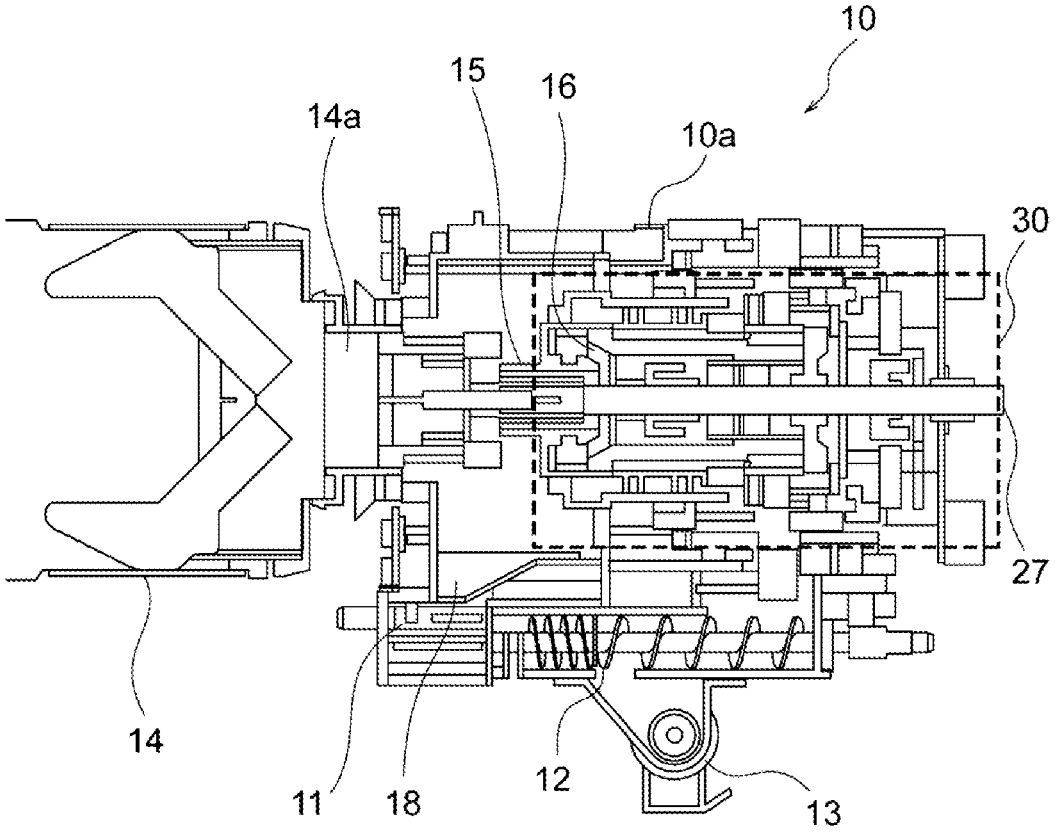
FIG. 2 is a side cross-sectional view of a toner supply device.

FIG. 2 is a side cross-sectional view of the toner supply device. As illustrated in FIG. 2, a supply port 14*a* of the toner cartridge 14 is set at the toner supply body 10*a* (hopper) of the toner supply device 10.

The toner from the toner cartridge 14 supplied from the supply port 14*a* is stored in the toner storage portion 18. The stored toner is conveyed to the development device 43 (see FIG. 1) by a plurality of screws inside the toner supply body 10*a*. Also, the plurality of screws include an agitation screw 11 (agitation member), and a first screw 12 (first conveyance member), and a second screw 13 (second conveyance member) as conveyance members.

Also, when toner is replenished from the toner cartridge 14, a supply port opening/closing mechanism 30 is engaged with a cap 15 provided at a front edge of the toner cartridge 14. Thus, the toner cartridge 14 can be rotated, and toner can be replenished by the rotation of the toner cartridge 14. The supply port opening/closing mechanism 30 is provided with a cartridge driving shaft 27 which is configured to rotation-drive the toner cartridge 14 by a method described below. Details of the respective portions will be described below.

Figure 3:
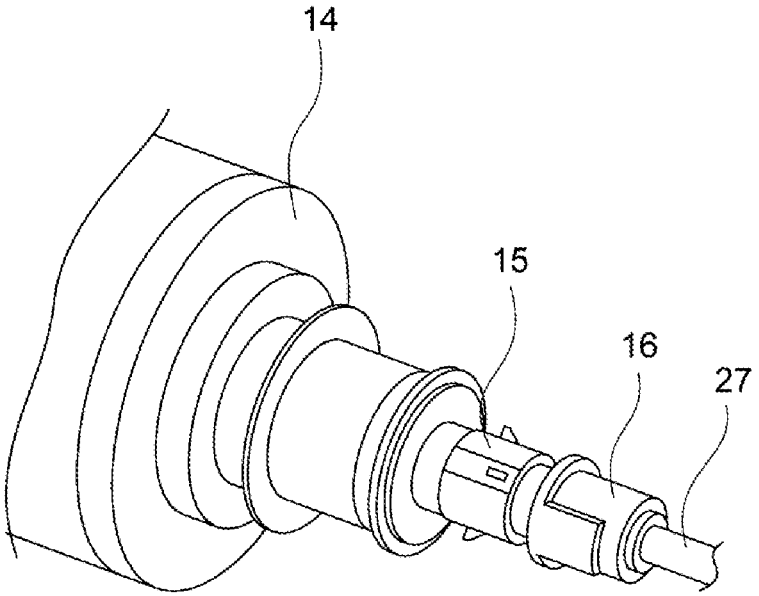
FIG. 3 is a view illustrating a relation of a coupling member between a toner cartridge and a cap.

First, a user sets the toner cartridge 14 at a main body according to an instruction. In this state, as illustrated in FIG. 3, the cap 15 provided at the front edge of the toner cartridge 14 is not engaged with the cartridge driving shaft 27 of the supply port opening/closing mechanism 30. For this reason, toner cannot be replenished from the toner cartridge 14.

Next, when a detection sensor (not illustrated) detects the secure setting of the toner cartridge 14 by the user, a driving source controller 103 (which will be described below) drives the cartridge driving shaft 27 of the supply port opening/closing mechanism 30 included in the toner supply body 10*a*. By the driving of the cartridge driving shaft 27, the cap 15 provided at the front edge of the toner cartridge 14 is engaged with a coupling member 16, and the cap 15 provided at the front edge of the toner cartridge 14 is opened. The supply port opening/closing mechanism 30 is driven by using a driving source 21 (cartridge driving source).

Figure 4:
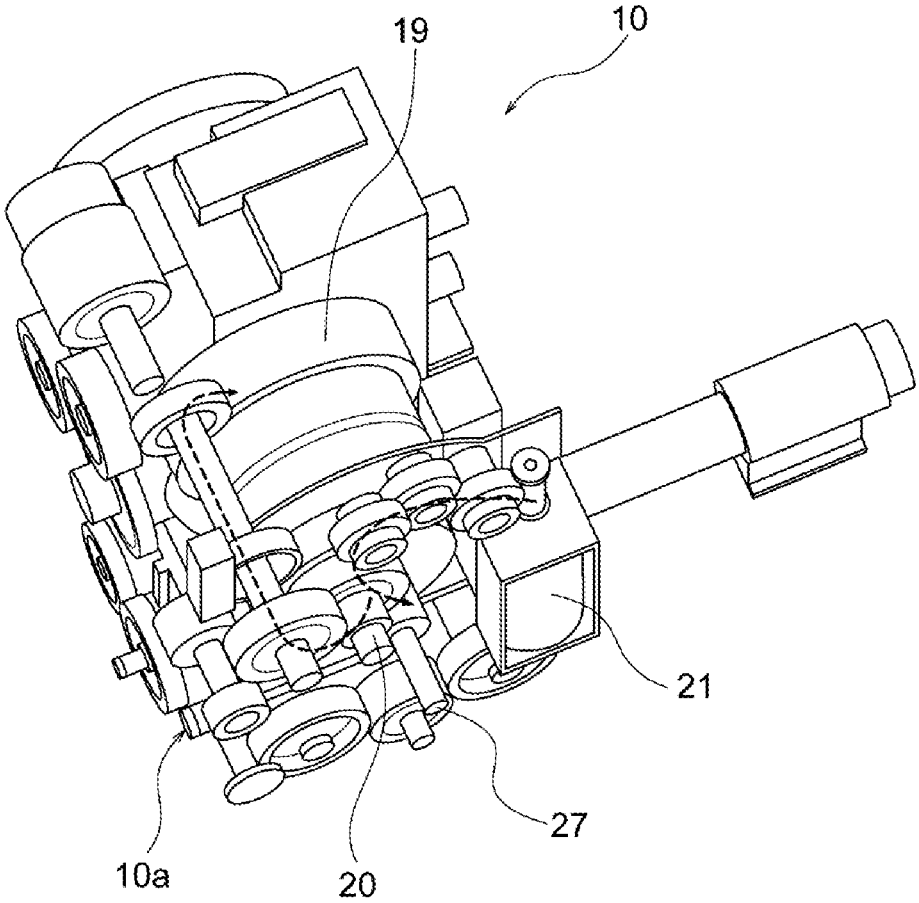
FIG. 4 is a perspective view illustrating a driving configuration of the toner cartridge.
Figure 14:
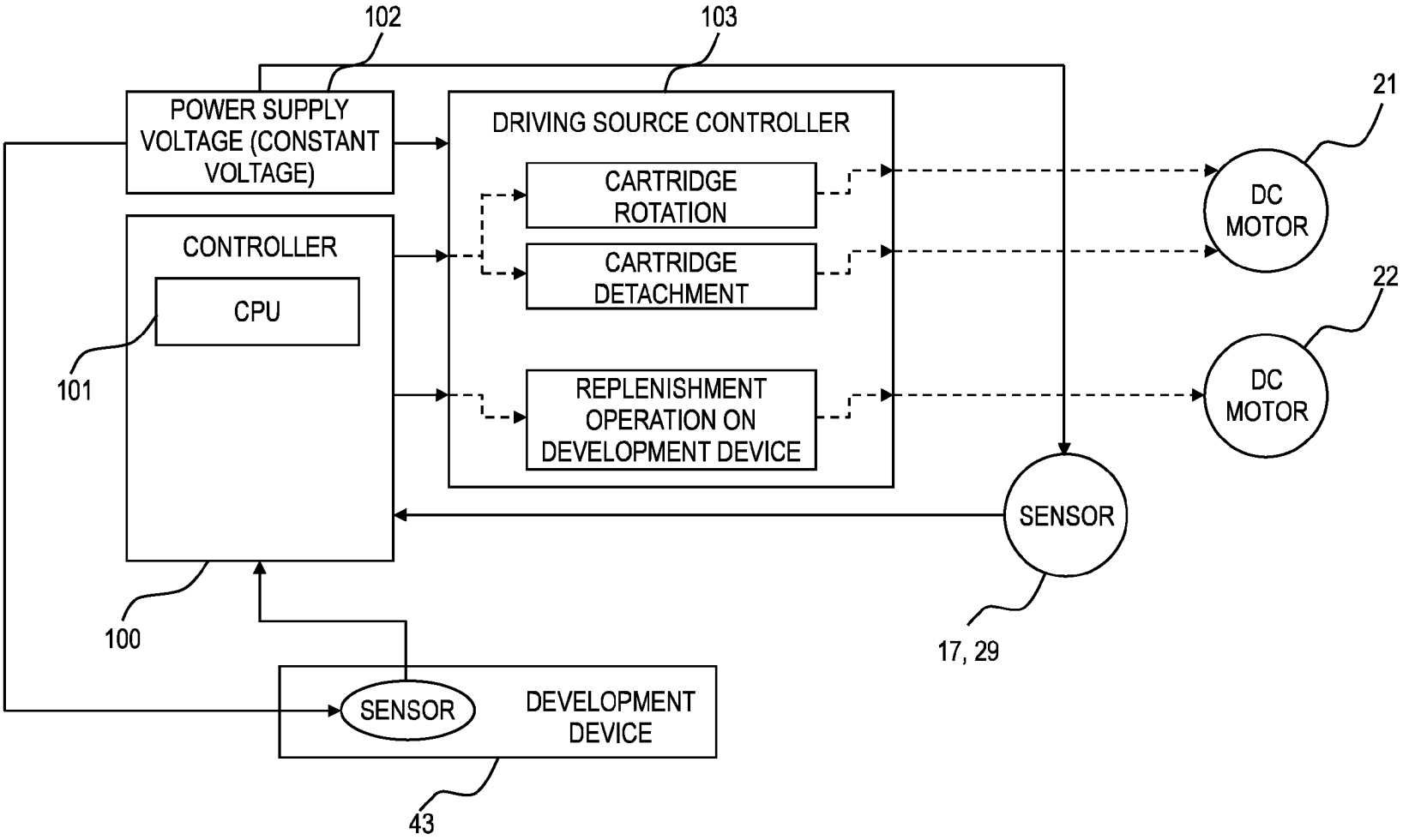
FIG. 14 is a control block diagram of the image forming apparatus.

FIG. 4 is a perspective view illustrating a driving configuration of the toner cartridge. When the driving source 21 is forward-rotated, a driving force is transmitted to a cam gear 19 by a gear drive train to drive the supply port opening/closing mechanism 30, as illustrated in FIG. 14.

Figure 5:
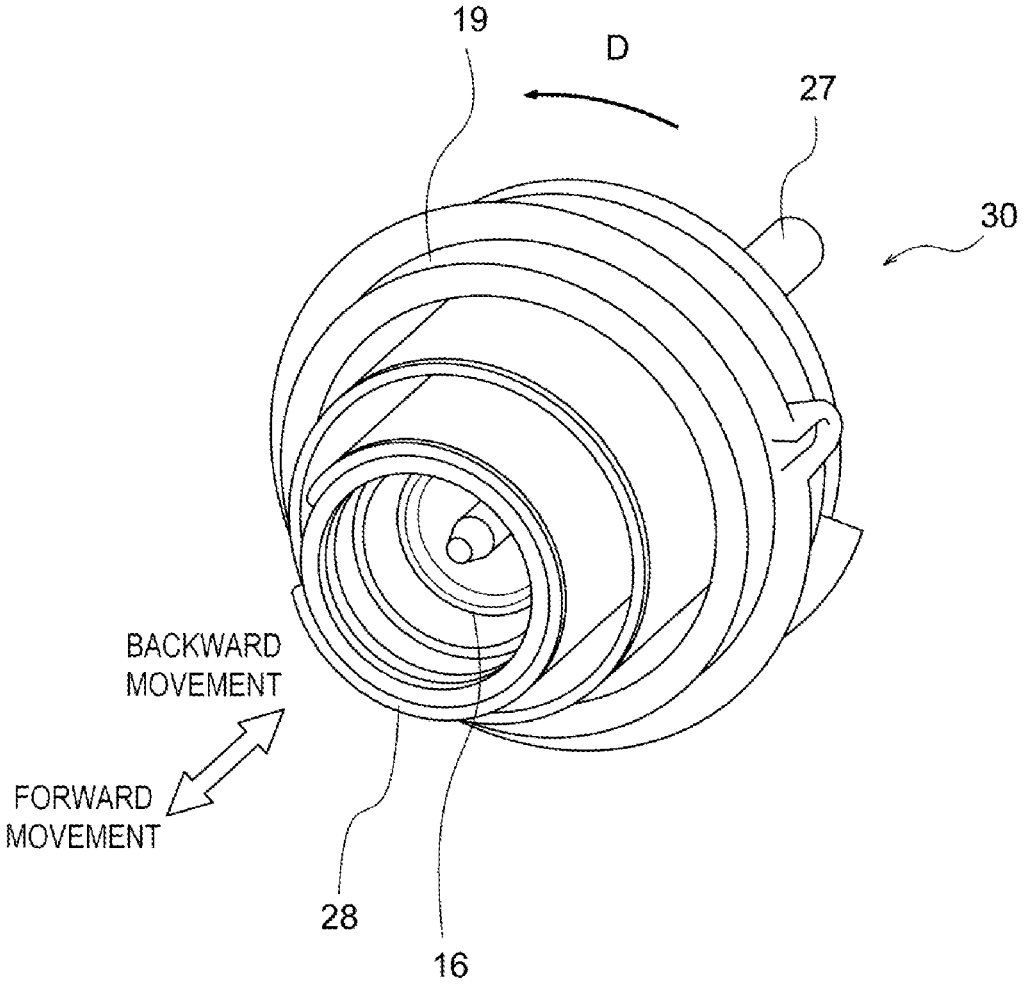
FIG. 5 is an enlarged perspective view of a cap opening/closing mechanism.

FIG. 5 is an enlarged perspective view of a cap opening/closing mechanism. Details of the supply port opening/closing mechanism 30 will be described with reference to FIG. 5.

A groove (not illustrated) is formed inside the cam gear 19. For this reason, when the cam gear 19 is rotated in the direction of an arrow D in the drawing, a cylindrical member 28 provided at a center portion moves forward. At this time, the cap 15 at the front edge of the toner cartridge 14 is engaged with the coupling member 16 which is coupled with the cap 15.

Figure 6:
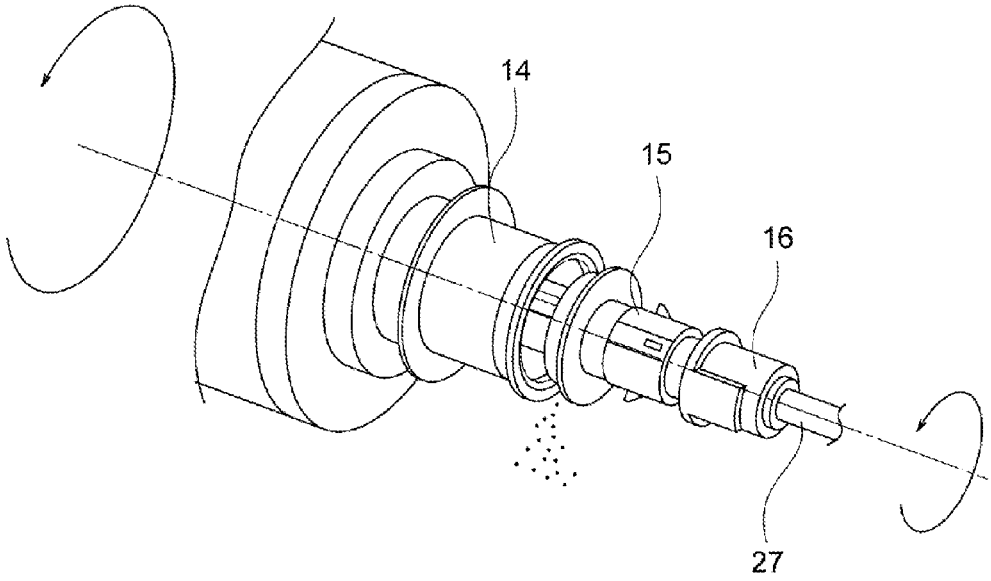
FIG. 6 is a view illustrating a state where the coupling member is drawn from the cap.

Also, when the cam gear 19 is rotated in the arrow direction, the cylindrical member 28 moves backward, thereby drawing the cap 15. This state is illustrated in FIG. 6. FIG. 6 is a view illustrating a state where the coupling member is drawn from the cap.

At this time, the cap 15 is drawn with the cap 15 and the coupling member 16 engaged with each other. For this reason, when the driving source 21 illustrated in FIG. 4 is reverse-rotated, a driving force is diverged by a one-way gear 20 and is transmitted to the cartridge driving shaft 27.

Then, since the coupling member 16 and the cartridge driving shaft 27 are coupled and integrated, the coupling member 16 is rotated by the rotation of the cartridge driving shaft 27 as illustrated in FIG. 6. Also, since the cap 15 engaged with the coupling member 16 is rotated, the toner cartridge 14 is also rotated. Thus, toner is replenished from the toner cartridge 14 into the toner supply body 10*a*.

Next, the toner storage portion 18 inside the toner supply body 10*a* will be described in detail. The toner storage portion 18 is provided with a toner sensor 17 (toner detection sensor). When toner is present on the surface of the toner sensor 17, the pressure of the toner is detected and it is recognized that toner T is present in the toner storage portion 18.

Figure 7:
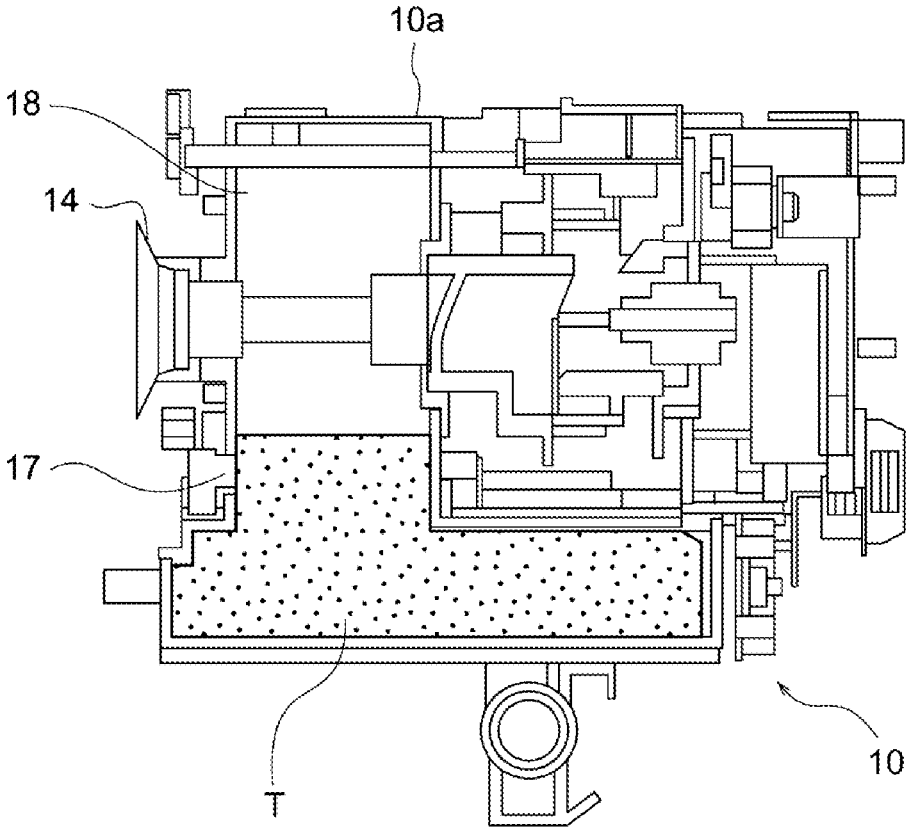
FIG. 7 is a side cross-sectional view illustrating a state where a storage portion of the toner supply device is filled up.

FIG. 7 is a side cross-sectional view illustrating a state where a storage portion of the toner supply device is filled up. In general, the toner T inside the toner storage portion 18 is in the state illustrated in FIG. 7. That is, the toner T arrives above the toner sensor 17, and the toner storage portion 18 is filled with the toner T.

Figure 8:
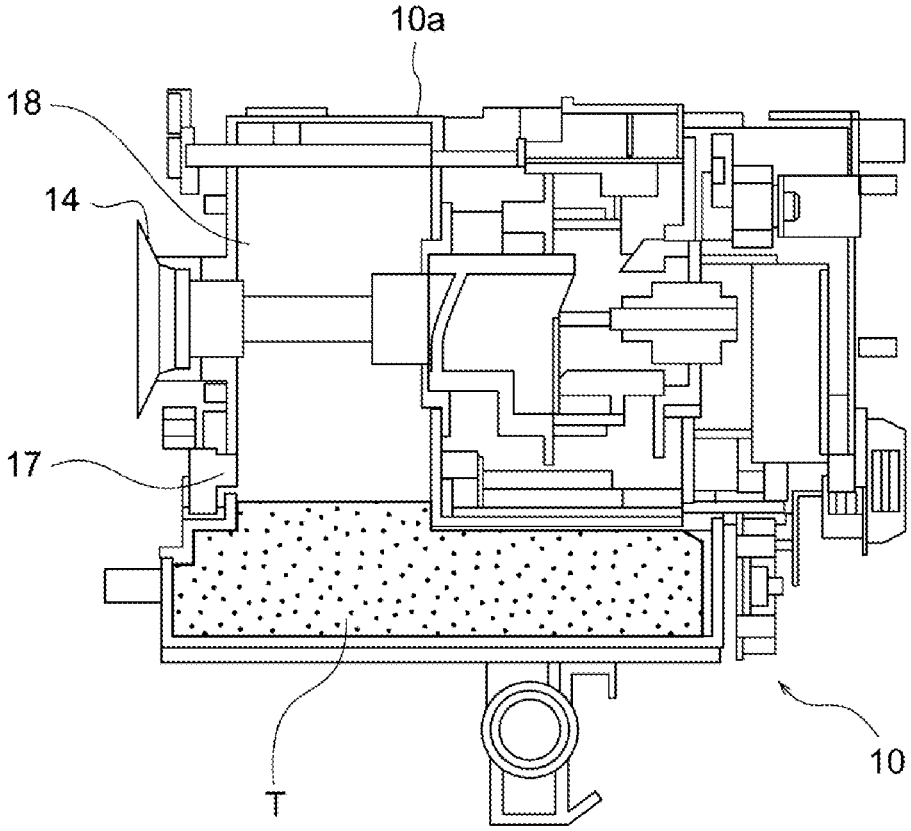
FIG. 8 is a side cross-sectional view illustrating a state where toner supply to the storage portion of the toner supply device is necessary.

On the other hand, when the toner of the toner storage portion 18 is consumed in the process of replenishment into the development device 43, the state is as illustrated in FIG. 8. FIG. 8 is a side cross-sectional view illustrating a state where toner supply to the storage portion of the toner supply device is necessary.

As illustrated in FIG. 8, since the toner T is not present on the surface of the toner sensor 17, it is recognized that the toner T is not present in the toner storage portion 18. In this case, toner is supplied from the toner cartridge 14 such that the toner T is present in the toner storage portion 18.

Figure 9:
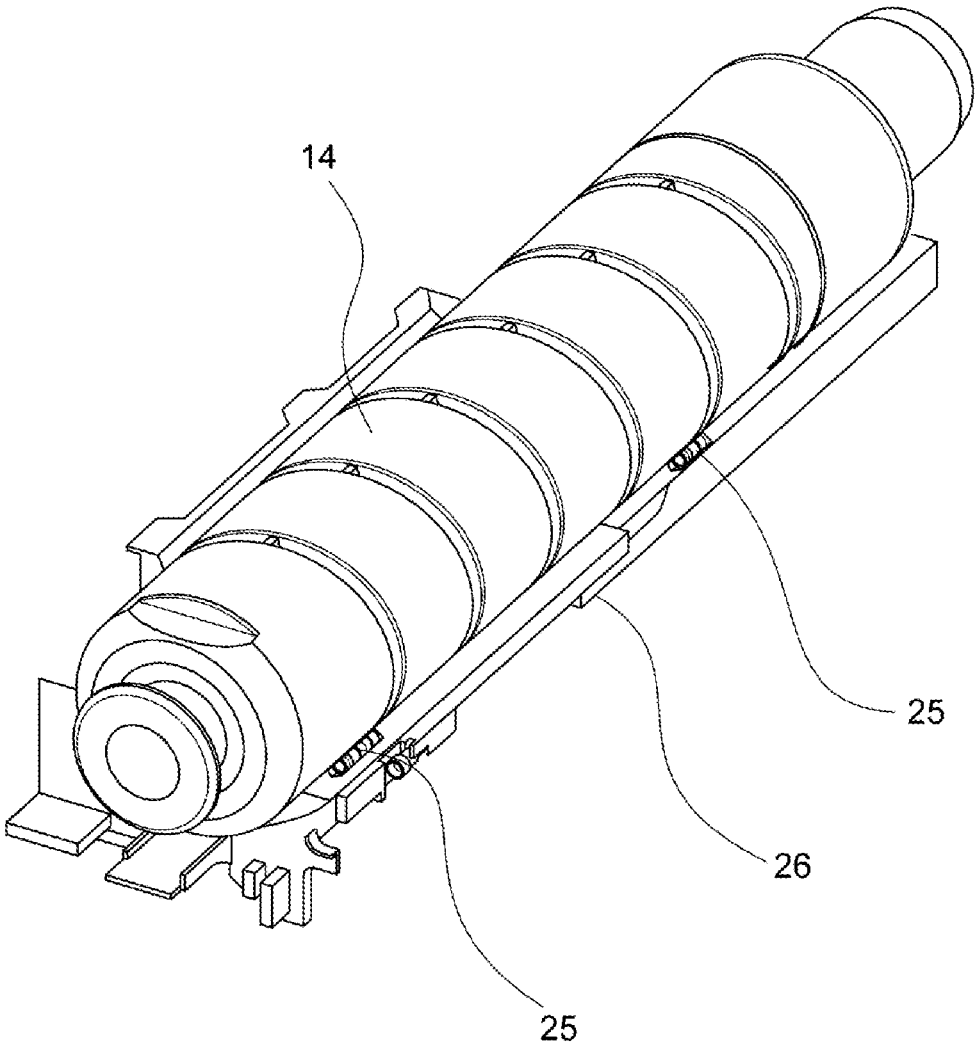
FIG. 9 is a perspective view illustrating a set state of the toner cartridge to a main body.

FIG. 9 is a perspective view illustrating a set state of the toner cartridge to the main body. As illustrated in FIG. 9, the toner cartridge 14 has the shape of a bottle where a screw configuration is formed at the toner cartridge 14. The toner cartridge 14 is set at a cartridge tray 26 of the main body.

Figure 10:
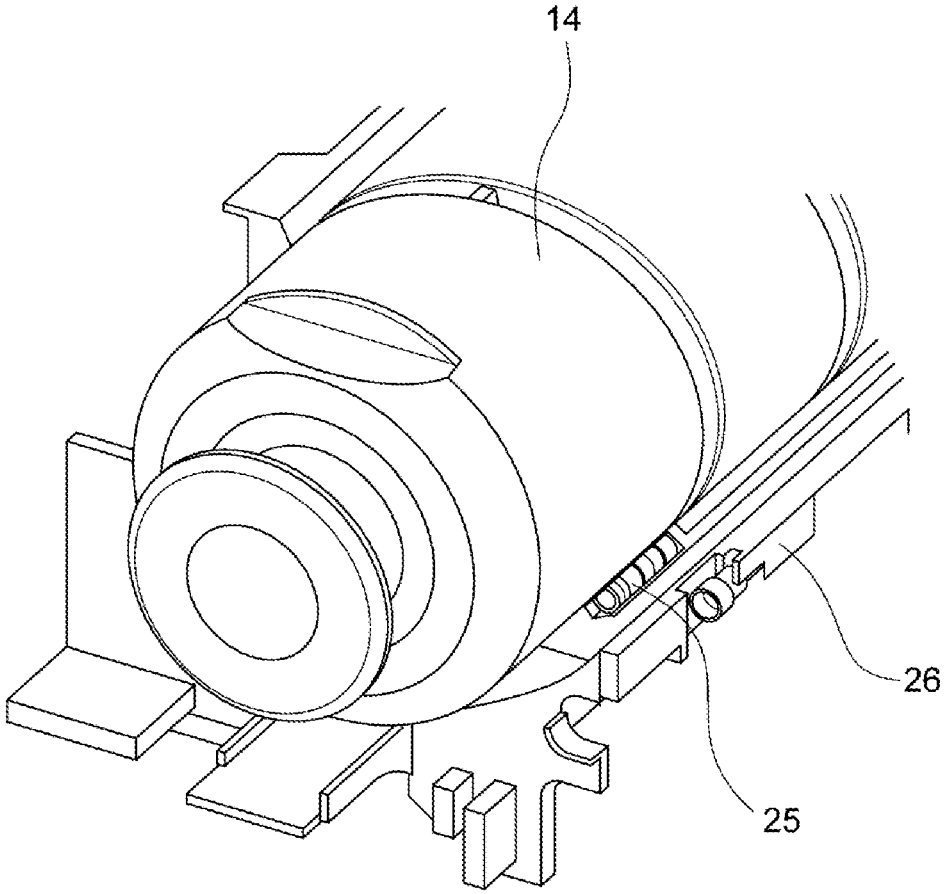
FIG. 10 is a view illustrating a relation between the toner cartridge and a roller.

FIG. 10 is a view illustrating a relation between the toner cartridge and a roller. As illustrated in FIG. 10, the cartridge tray 26 is provided with a plurality of rollers 25. By the rollers 25, the toner cartridge 14 can be smoothly rotation-driven.

When the toner cartridge 14 is rotated, the toner contained in the toner cartridge 14 is conveyed to the supply port 14*a* of the toner cartridge 14 and is discharged. Thus, the toner can be supplied to the toner storage portion 18.

Figure 11:
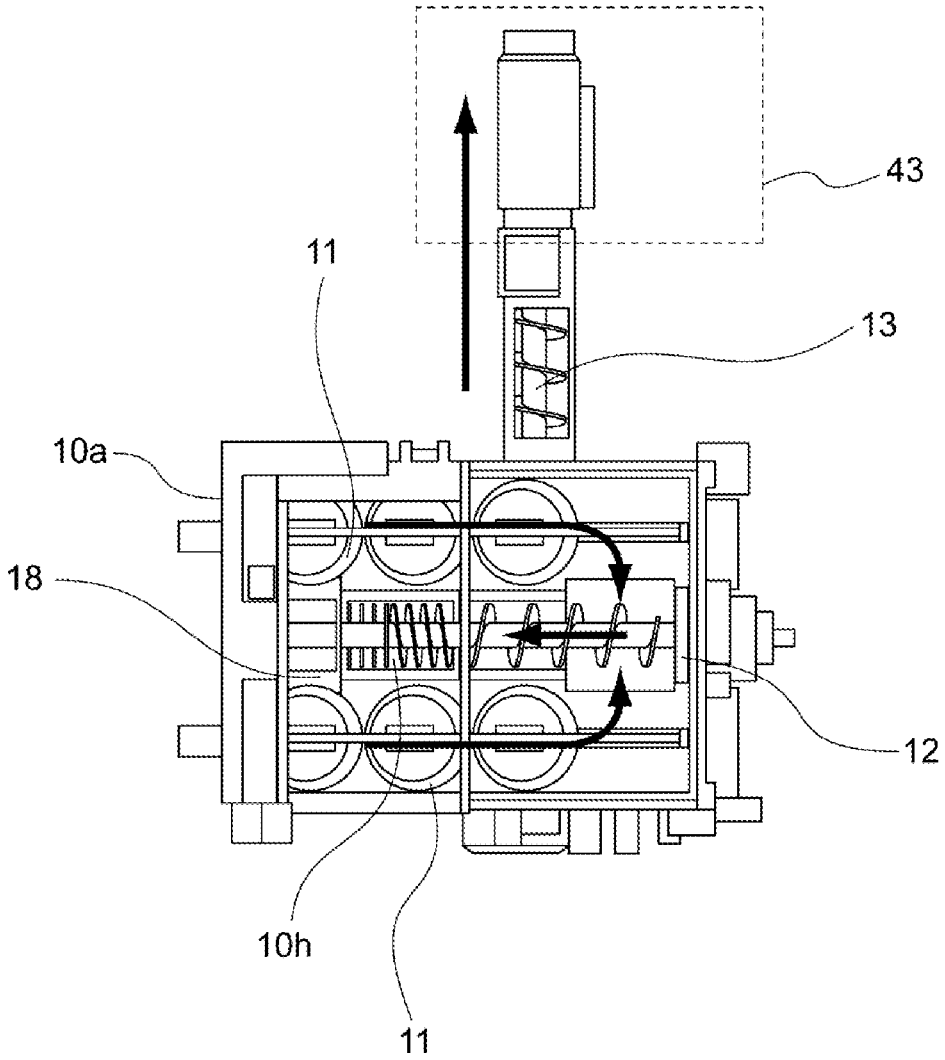
FIG. 11 is a top view of the toner supply device.

Lastly, a supply function from the toner supply device 10 to the development device 43 will be described in detail. FIG. 11 is a top view of the toner supply device 10.

As illustrated in FIG. 11, by the output of a sensor 43*a* (see FIG. 14) inside the development device 43, a controller 100 (see FIG. 14) receives a toner shortage signal. Then, the signal is transmitted to the toner supply device 10 such that an optimal amount of toner is supplied to the development device 43.

The toner of the toner storage portion 18 is conveyed in the arrow direction by the agitation screw 11, and is conveyed to the center portion by the first screw 12.

Herein, the agitation screw 11 has an elliptical shape for toner agitation, and is hollow. This configuration can prevent the occurrence of clogging of the toner in the toner conveyance process, so that the toner can be smoothly conveyed while being agitated.

The toner conveyed to the center portion of the toner supply body 10*a* falls from an empty hole 10*h* at the center portion illustrated in FIG. 11 and is conveyed to the second screw 13.

Figure 12:
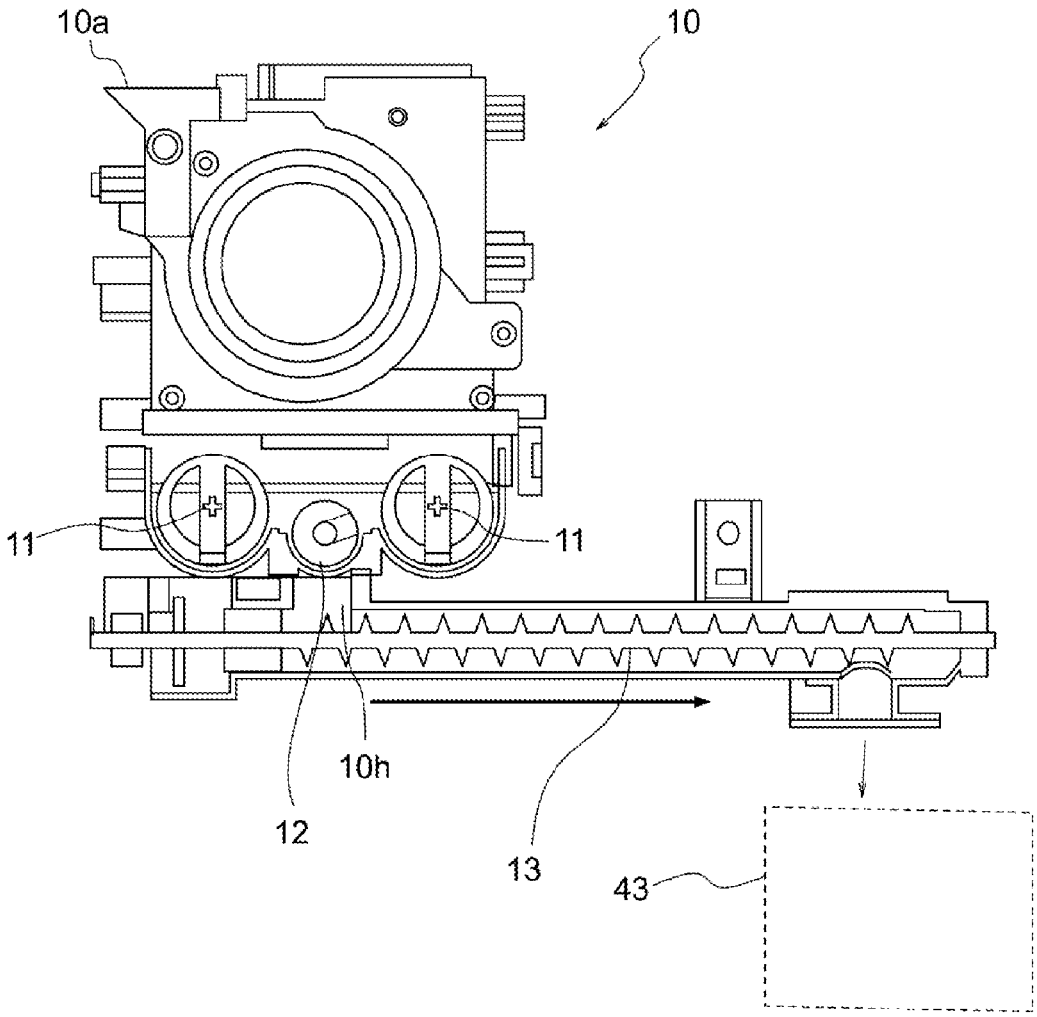
FIG. 12 is a side view illustrating a configuration of the toner supply device.

FIG. 12 is a side view illustrating a configuration of the toner supply device. As illustrated in FIG. 12, the toner conveyed from the first screw 12 to the center portion falls to the second screw 13 and is finally conveyed to the development device 43 by the second screw 13.

Figure 13:
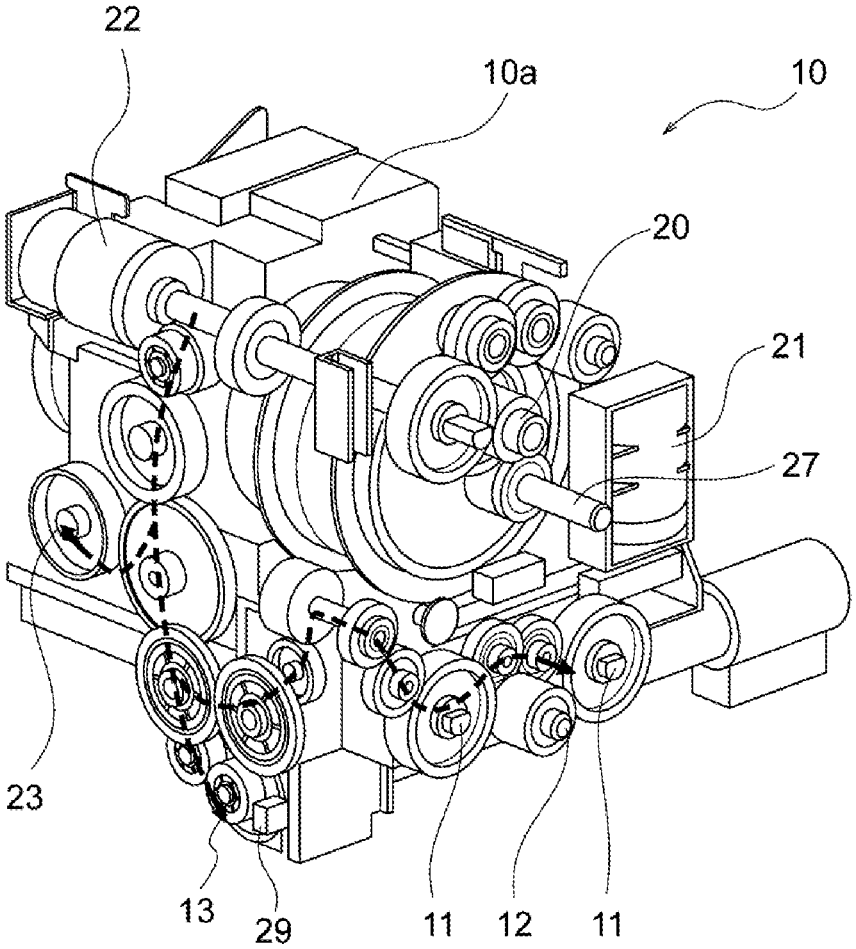
FIG. 13 is a perspective view illustrating a driving configuration involved in toner supply.

Next, a driving configuration of the toner supply device 10 will be described. FIG. 13 is a perspective view illustrating a driving configuration involved in toner supply.

When a toner supply request signal from the development device 43 is transmitted to the toner supply device 10, a driving source 22 (rotating member driving source) illustrated in FIG. 13 is driven, and the driving is transmitted by a gear train as represented by an arrow. Then, the screws (agitation screw 11, first screw 12, and second screw 13) inside the toner supply device 10 are rotated, the toner is conveyed to the development device 43 which is provided at the downstream side in the toner conveyance direction.

There is known a configuration of separately driving the agitation screw 11. However, when a separate driving source is necessary, or when forward/reverse driving is performed, one-way gear is necessary, which results in an expensive configuration. According to the configuration of the present embodiment, the toner can be replenished to the development device 43 by one driving source 22, thus implementing an inexpensive configuration.

The movements of the driving source 21 and the driving source 22, and the outputs of the toner sensor 17 and a toner sensor 29 are transmitted to and controlled by the controller 100. FIG. 14 is a control block diagram of the image forming apparatus.

As illustrated in FIG. 14, the controller 100 drive-controls the driving source controller 103 by receiving detection signals (output values) from the sensor 43*a* (remaining amount detection sensor) which detects the toner remaining amount in the development device 43, and from the toner sensor 17 and the toner sensor 29 of the toner supply device 10. Also, the controller 100 has a power supply voltage 102, and supplies an optimal voltage to the driving source 21 and the driving source 22.

The timing of driving the driving source 21 and the driving source 22, which are DC motors, and the outputs of the toner sensor 17 and the toner sensor 29 are overall controlled by the controller 100. From the detection result of the toner sensor 17 and the driving states of the agitation screw 11, the first screw 12, and the second screw 13, the controller 100 determines whether to perform a replenishment operation of the toner cartridge 14. Then, the respective movements are performed by a CPU 101 included in the controller 100.

Herein, a sequence for replenishing toner from the toner cartridge 14 into the toner supply body 10*a* will be described. FIG. 15 is a control flow chart of the first embodiment.

As described above, when the toner sensor 17 provided in the toner storage portion 18 determines the shortage of toner, a command for driving the toner cartridge 14 according to the flow chart is issued.

The flow chart is set to two stages according to the toner remaining amount of the toner cartridge 14. The first state is executed when an abundant amount of toner is present in the toner cartridge 14 in an early stage, and the second stage is executed when a small amount of toner remains in the toner cartridge 14. Transition from the first stage to the second stage is automatically performed when the toner amount in the toner cartridge 14 is equal to or smaller than a predetermined amount.

Figure 15A:
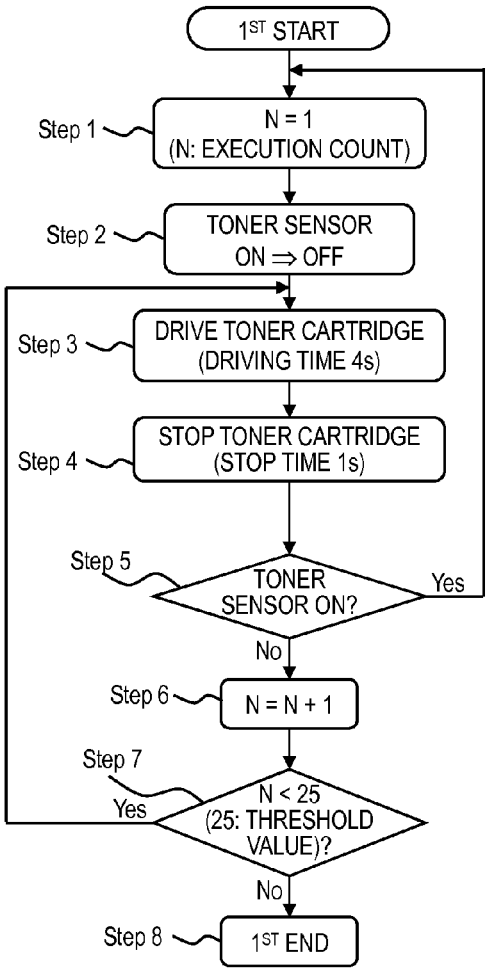
FIG. 15A is a control flow chart of the first embodiment.

First, the flow chart of the first stage is illustrated in FIG. 15A. First, in Step 1, as preparation for driving the toner cartridge 14, an execution count is set to 1.

In Step 2, toner is replenished to the development device 43, and an operation of the toner cartridge 14 is not performed until the toner sensor 17 is turned off.

When the toner sensor 17 is turned off, since the signal of the sensor in FIG. 14 is transmitted to the controller 100, the flow proceeds to Step 3.

In Step 3, in order to drive the toner cartridge 14, a command is transmitted from the controller 100 to the driving source controller 103. Thus, the toner cartridge 14 starts driving. The toner cartridge 14 is driven for four seconds at one time, and the toner cartridge 14 stops driving for one second in Step 4. The stopping for one second is to increase the detection accuracy by performing the presence/absence detection by the toner sensor in the state where the replenished toner is calmed down. The present invention can also be applied to a configuration in which the toner cartridge is not intermittently driven.

In Step 5, the state of the toner sensor 17 is checked.

When the toner sensor 17 is an on state, the information is transmitted to the controller 100, and the flow returns to Step 1. Thus, the execution count is reset to 1. Then, the flow is on standby until the toner sensor 17 is turned off by the replenishment operation of the development device 43.

On the other hand, when the toner sensor 17 is still turned off, the execution count is increased by one in Step 6.

In Step 7, it is determined whether the execution count reaches a threshold value. When the execution count does not reach the threshold value, the flow returns to Step 3 to repeat the operation. When the execution count reaches the threshold value in Step 7, the flow chart of the first stage is ended in Step 8.

Figure 15B:
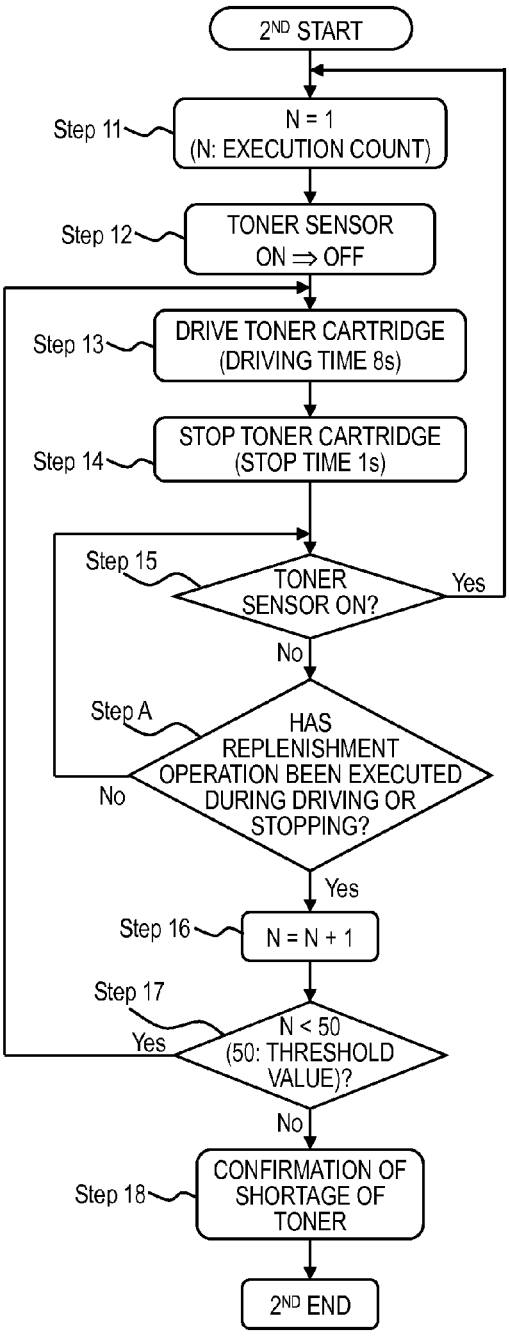
FIG. 15B is a control flow chart of the first embodiment.

Next, the flow chart of the second stage is executed. The flow chart of the second stage is illustrated in FIG. 15B. As described above, the second stage is performed when a small amount of toner remains in the toner cartridge 14.

In the second stage, the driving time of the toner cartridge 14 in Step 13 is set to eight seconds. This is to shorten the stopping time of the toner cartridge 14, because the discharge performance in the toner cartridge 14 is degraded. Except for the driving time, Step 11 to Step 15 are the same as Step 1 to Step 5 of the first stage. In the second stage, Step A for toner cartridge driving control is provided after Step 15.

In Step A, during the execution of Step 13 or Step 14, that is, during one-cycle operation of the toner cartridge 14, the following checking is performed. That is, whether or not a replenishment operation to the development device 43 is performed, or whether or not a replenishment operation is performed when the driving of the toner cartridge 14 is stopped, is checked. Also, herein, one cycle corresponds to driving for eight seconds and stopping for one second. In other words, whenever a predetermined time (8+1=9 seconds in the present embodiment) has lapsed, the controller 100 determines whether a replenishment operation to the development device 43 is performed during the lapse time, and determines whether to continue a series of replenishment operations of the toner cartridge 14.

Specifically, when an operation of supplying a constant amount of toner to the development device 43 provided at the downstream side of the toner storage portion 18 is performed during the driving of the toner cartridge 14, the driving of the toner cartridge 14 is continued. On the other hand, when an operation of supplying a constant amount of toner to the development device 43 provided at the downstream side of the toner storage portion 18 is not performed during the operation of the toner cartridge 14, the driving of the toner cartridge 14 is stopped.

The checking flow is described with reference to the block diagram of FIG. 14. Information of the sensor 43*a* disposed at the development device 43 is always transmitted to the controller 100. Then, the controller 100 makes a determination from the output signal of the sensor 43*a*. That is, the controller 100 receives the signal from the sensor 43*a* as a toner request signal, determines a state such as a toner density, and determines whether a replenishment operation is necessary, from the determination result.

When it is determined that the replenishment operation is necessary, a command for performing the replenishment operation is issued to the driving source controller 103. For this reason, in Step A, it is checked whether the command for performing the replenishment operation has been issued. The determination as to whether the replenishment operation to the development device 43 is being executed, that is, the determination as to whether the first screw 12 and the second screw 13 are being driven (whether the replenishment operation is being executed), may be other than the command for performing the replenishment operation. For example, based on the detection result of the sensor 43*a*, whether the replenishment operation to the development device 43 is being executed may be determined.

During the execution of Step 13 or Step 14, the operation of the toner cartridge 14 is started. Thereafter, when the replenishment operation to the development device 43 is being executed, the flow proceeds to Step 16 and executes the flow chart in the same sequence as the first stage.

Herein, when the replenishment operation to the development device 43 is not being executed, the flow returns to Step 15 and the toner cartridge 14 repeats stopping. That is, the toner cartridge 14 stops a series of replenishment operations.

At this time, after the replenishment operation to the development device 43 is performed, Step 16 can be executed. That is, when detecting the shortage of toner from the detection result of the toner sensor 17 and detecting that the replenishment operation to the development device 43 has been performed after the stop of the replenishment operation, the controller 100 resumes a series of replenishment operations of the toner cartridge 14.

That is, unless the state of the sensor 43*a* in the development device 43 requires the replenishment operation, a command for the replenishment operation to the development device 43 is not generated and the operation of the toner cartridge 14 is also stopped.

When a replenishment operation to the development device 43 is performed, the agitation screw 11 is rotated along with the replenishment operation, and the toner accumulated in the shape of a mountain is collapsed to some extent, and the toner as much as replenished is consumed. For this reason, even when there is toner accumulated near the outlet port, the height of the mountain is lowered certainly.

Also, even when the mountain of toner could not be completely collapsed in the one-cycle replenishment operation, the operation of the toner cartridge 14 waits for a toner replenishment operation every cycle. For this reason, the toner cartridge 14 does not continue to operate unnecessarily.

Through the performance of the above operation, when the cycle count is satisfied in Step 17 up to a threshold value of 50, it is determined that there is shortage of toner in the toner cartridge. That is, after the agitation and replenishment operation is performed at least 50 times, it is determined that there is shortage of toner. For this reason, during that time, there is an opportunity for resolving the toner accumulated in the shape of a mountain.

Also, since the agitation is performed along with the replenishment operation, the toner is not damaged unnecessarily. For this reason, there is no fear that the toner will be degraded. Also, the toner in the hopper can be agitated when the toner cartridge is driven. For this reason, when toner is replenished from the toner cartridge, the interruption of discharge due to the accumulation of a toner in the shape of a mountain in the hopper can be suppressed. Therefore, determining that there is shortage of toner even when toner remains in the toner cartridge (arrival at the threshold value of 50) can be suppressed.

When the toner sensor 17 determines that there is toner, the threshold value is reset. For this reason, the toner inside the toner cartridge 14 can be continuously discharged with high efficiency.

In the present embodiment, a series of replenishment operations of the toner cartridge 14 are started based on the detection result of the toner sensor 17. Also, based on the detection result of the toner sensor 17, and information about the driving of the first screw 12 and the second screw 13 at every period after the start of a series of replenishment operations, whether to continue a series of replenishment operations of the toner cartridge 14 is controlled.

Also, in the present embodiment, Step A is not provided in the first stage. Thus, if the toner cartridge 14 with a small toner capacity is attached, the flow can quickly proceed to the second stage without waiting for the toner replenishment operation.

Also, while the threshold value is set to 50 and the one-cycle operation is set to eight-second driving and one-second stopping, the present invention is not limited thereto. The set values may be modified according to the fluidity of the toner and the shape of the toner cartridge 14, meeting the optimal conditions.

Second Embodiment

Figure 16A:
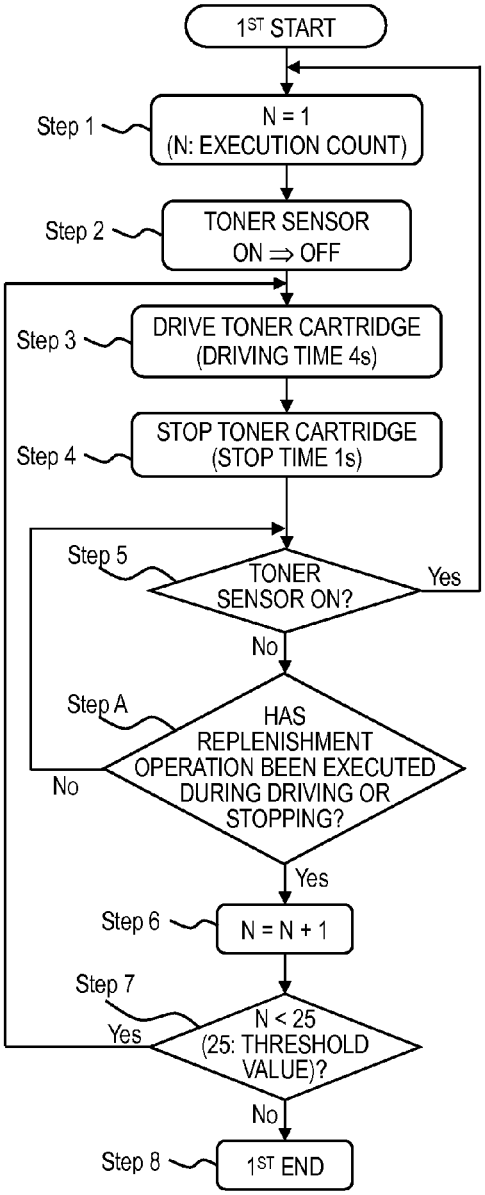
FIG. 16A is a control flow chart of the second embodiment.
Figure 16B:
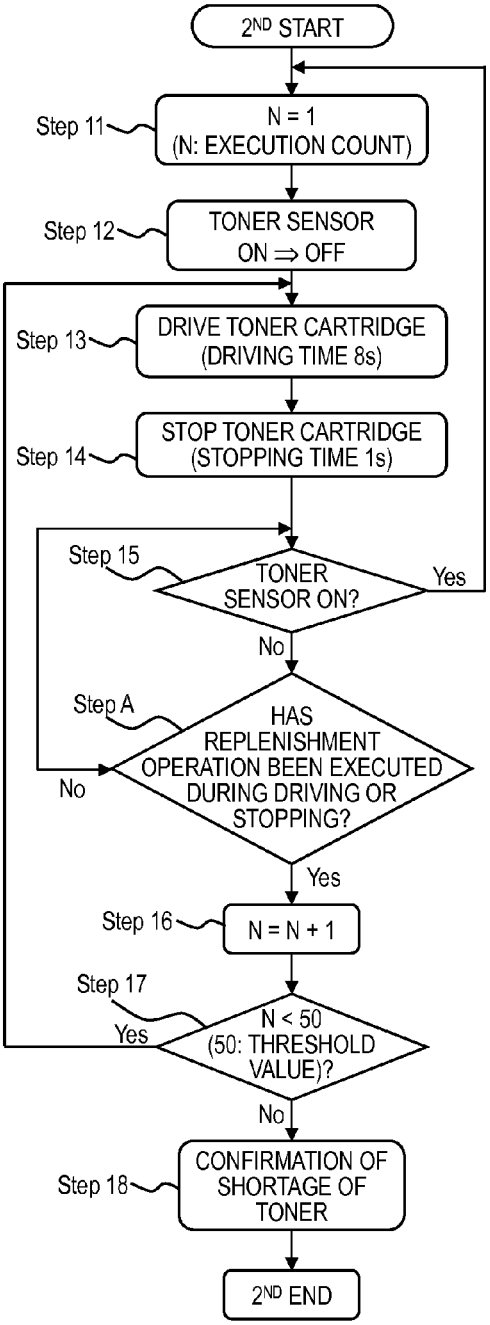
FIG. 16B is a control flow chart of the second embodiment.

FIG. 16 is a control flow chart of the second embodiment. The second embodiment is different from the first embodiment in that Step A is also provided in the flow chart of FIG. 16A of the first stage.

In general, when there is a large amount of toner in the toner cartridge 14, a large amount of toner is discharged, so that the accumulation of toner in the shape of a mount, which is to be solved, is not assumed. However, according to the state of toner in the toner cartridge 14 and the use environment, there is a possibility that the toner discharge amount will be temporarily decreased. In this case, as in the present embodiment, an effect can be exerted by applying Step A to the first state that is an early stage.

By the above configuration, the degradation of the toner inside the toner storage portion can be maximally suppressed, and the damage by the continuous replenishment of toner to the toner storage portion in the state where the toner inside the toner storage portion is not agitated can be suppressed.

Third Embodiment

The driving method of the present embodiment is driving by PWM (Pulse Width Modulation) control. Herein, the driving method by PWM control will be described in detail. FIG. 17C is a control block diagram of the image forming apparatus according to the third embodiment.

Figure 17A:
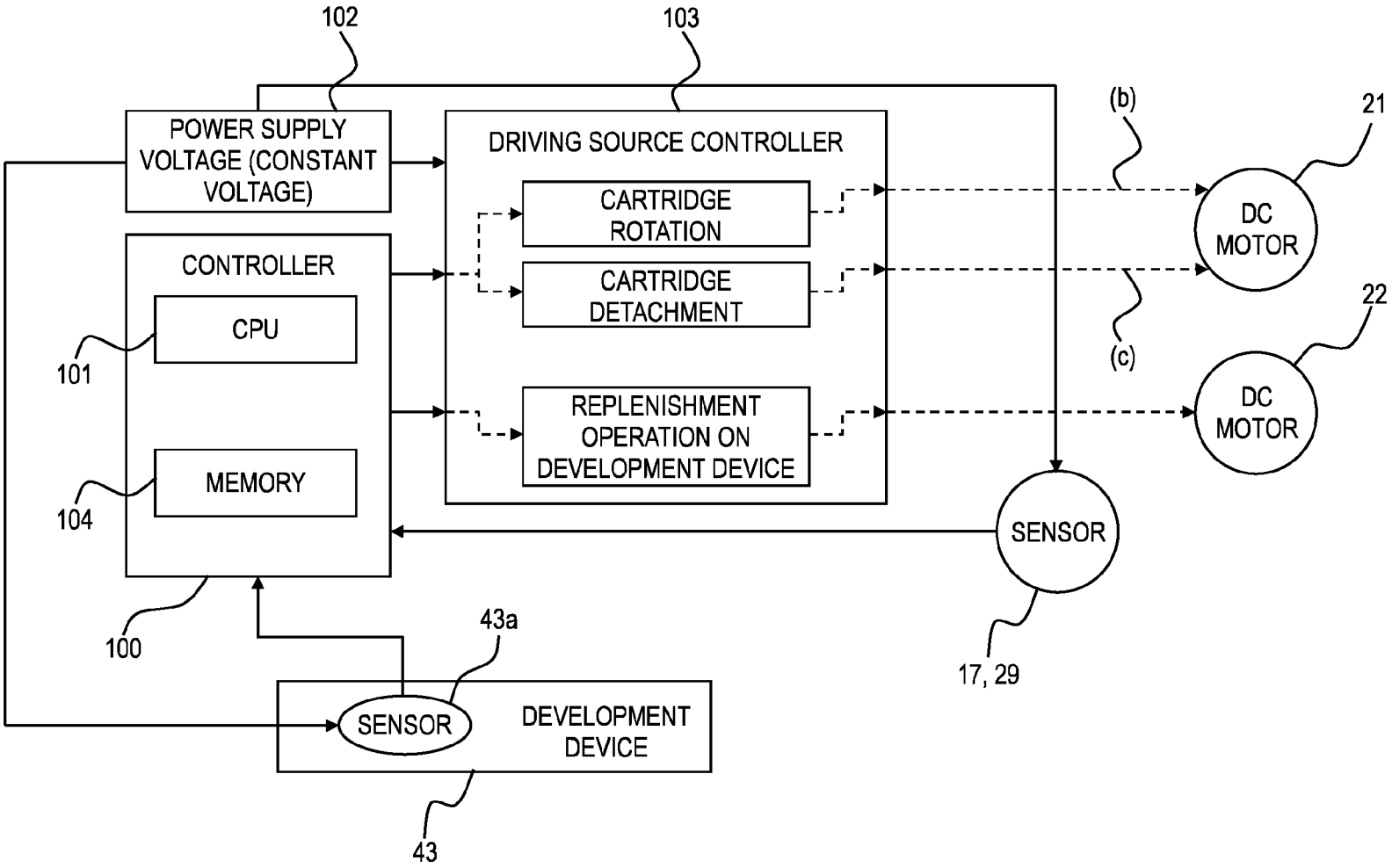
FIG. 17A is a control block diagram of an image forming apparatus according to the third embodiment.
Figure 17C:
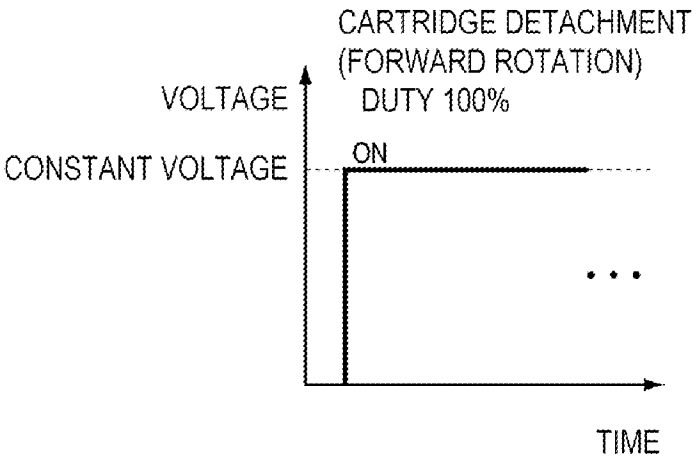
FIG. 17C is a control block diagram of the image forming apparatus according to the third embodiment.
Figure 17B:
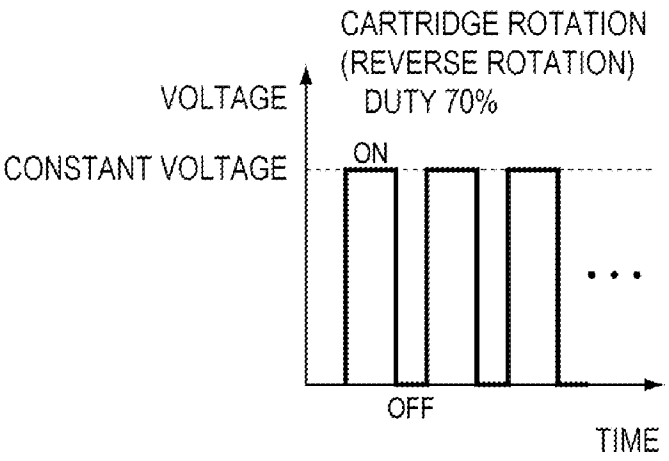
FIG. 17B is a control block diagram of the image forming apparatus according to the third embodiment.

As illustrated in FIG. 17, in the state where a constant voltage is applied, a switching element inside the driving source controller 103 switches the on and off states of a voltage applied to the driving source 21 at a period of 2 kHz. At this time, by setting an on/off time ratio (hereinafter, referred to as a duty), an effective voltage value per unit time input to the driving source 21 can be modified.

For example, when the duty is 50%, since the on and off have the same ratio, the voltage input to the driving source 21 is substantially the same as the half of a predetermined applied voltage. Also, when a command for an opening/closing operation is issued, the driving source controller 103 detects the command. In the opening/closing of the toner cartridge 14, the driving source 21 is forward-rotated at a duty of 100%. On the other hand, when the toner cartridge 14 is rotated, a command for rotation is detected by the driving source controller 103 and the driving source 21 is reverse-rotated at a duty of 70%.

In other control configurations, as illustrated in FIG. 17, the movement of a driving source 21 and the movement a driving source 22 (agitation conveyance member driving source), which will be described below, are controlled by the controller 100. Also, the outputs of a toner sensor 17 and a second screw rotation sensor 29, which will be described below, are transmitted to the controller 100 for control.

Also, the controller 100 drive-controls the driving source controller 103 by receiving detection signals (output values) from the sensor 43*a* (remaining amount detection sensor) which detects the toner remaining amount in the development device 43, and from the toner sensor 17 and the second screw rotation sensor 29 of the toner supply device 10. Also, the controller 100 has a power supply voltage 102, and supplies an optimal voltage to the driving source 21 and the driving source 22.

The timing of driving the driving source 21 and the driving source 22, which are DC motors, and the outputs of the toner sensor 17 and the second screw rotation sensor 29 are overall controlled by the controller 100. From the detection result of the toner sensor 17 and the driving states of the agitation screw 11, the first screw 12, and the second screw 13, the controller 100 determines whether to perform a toner replenishment operation by the driving of the toner cartridge 14. The respective portions are controlled by the CPU 101 based on the driving record information (driving history information) in a memory 104 (storage portion) of the controller 100 during a predetermined driving period.

As illustrated in FIG. 11, by the output of a sensor 43*a* (see FIG. 17) inside the development device 43, the controller 100 (see FIG. 17) receives a toner shortage signal. Then, the signal is transmitted to the toner supply device 10 such that an optimal amount of toner is supplied to the development device 43.

The toner of the toner storage portion 18 is conveyed in the arrow direction by the agitation screw 11, and is further conveyed to the center portion by the first screw 12.

Herein, the agitation screw 11 has an elliptical shape for toner agitation, and is hollow. This configuration can prevent the occurrence of clogging of the toner in the toner conveyance process, so that the toner can be smoothly conveyed while being agitated.

The toner conveyed to the center portion of the toner supply body 10*a* falls from an empty hole 10*h* at the center portion illustrated in FIG. 11 and is conveyed to the second screw 13.

Figure 18:
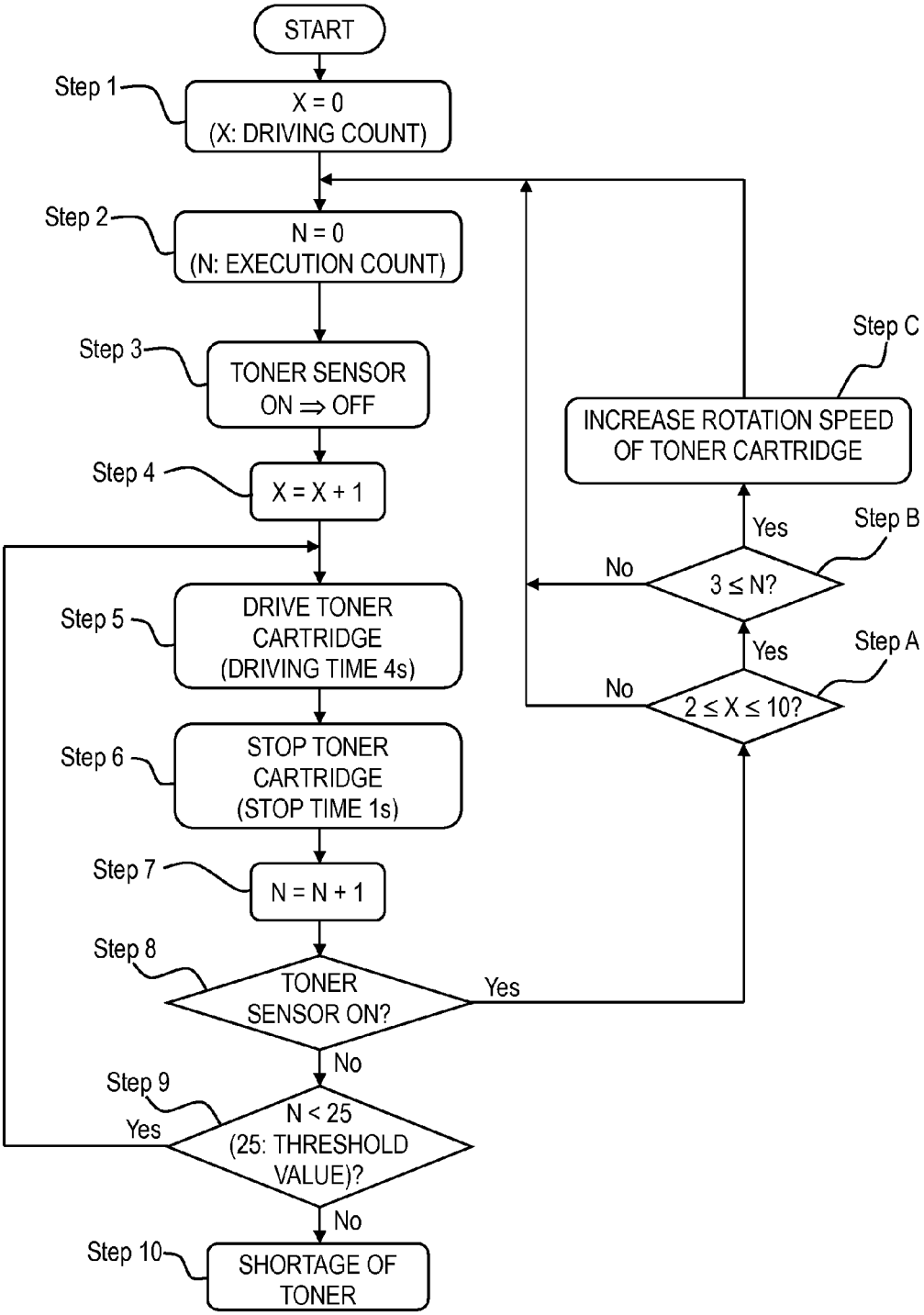
FIG. 18 is a control flow chart of the third embodiment.

Herein, a sequence for replenishing toner from the toner cartridge 14 into the toner supply device 10 will be described. FIG. 18 is a control flow chart of the third embodiment.

First, a driving count (operation count) X of the toner cartridge and an execution count N are set to 0 (Step 1, Step 2).

Herein, the driving count X is the number of times where the driving of the toner cartridge is necessary, that is, the number of times where the toner sensor 17 is turned off (shortage of toner). The driving count X is not reset unless the toner cartridge 14 is replaced. The execution count N is reset when the toner sensor 17 is turned on by the driving of the toner cartridge 14 (presence of toner). Details will be described below.

Next, toner is replenished to the development device 43, and an operation of the toner cartridge 14 is not performed until the toner sensor 17 is turned off (Step 3). When the toner sensor 17 is turned off, a signal of the sensor in FIG. 17 is transmitted to the controller 100. In response to the signal, the controller 100 executes driving and increases the driving count X by one (Step 4).

A command for driving the toner cartridge 14 is transmitted from the controller 100 of FIG. 17 to the driving source controller 103. Thus, the toner cartridge 14 starts driving. The toner cartridge 14 is driven for four seconds at one time (Step 5). Thereafter, the toner cartridge 14 stops driving for one second (Step 6). Accordingly, the driving of the toner cartridge 14 is performed once, and the execution time N is increased by one (Step 7). Herein, the state of the toner sensor 17 is checked (Step 8).

When the toner sensor 17 is still in an off state in Step 8, the execution count N is checked (Step 9). When it is equal to or smaller than a predetermined threshold value (25 in the present embodiment), the flow returns to Step 5 and performs the driving of the toner cartridge 14.

When the toner sensor 17 is an on state in Step 8, the information is transmitted to the controller 100. Lastly, the flow returns to Step 2 and resets the execution count N. Herein, three Steps featuring the present embodiment are provided before the reset of the execution count N. Next, the respective Steps will be described in brief.

In Step A, a new toner cartridge is set, and a driving count X where the toner sensor 17 is turned off is determined.

In Step B, when the toner cartridge performs replenishment on the toner supply device, an execution count N which is necessary to turn on the toner sensor is determined.

In Step C, the rotation number of the toner cartridge is controlled based on the determination result of Step B. Next, the respective steps will be described in detail.

First, in Step A, only in the case of a specific driving count X, the control (rotation number control) in the subsequent Step is performed. In Step A, when the toner cartridge is replaced with a new toner cartridge 14, the rotation speed of the toner cartridge 14 may be appropriately collected as soon as possible. For this reason, in the present embodiment, when the driving count X is from 2 to 10, Step B and Step C are executed.

This is because, when the rotation number is controlled in all periods until the toner cartridge 14 is empty of its toner, there is a fear that the toner cartridge 14 will be excessively rotated along with the variation of the toner inside the toner cartridge 14.

On the other hand, the reason for not performing from the first is that, when the toner cartridge is replaced with a new toner cartridge 14, the toner supply device 10 is almost empty of toner, and therefore it is apparent that the execution count necessary to turn on the toner sensor 17 is out of an appropriate range.

Next, in Step B, the execution count N necessary to turn on the toner sensor 17 is determined. Herein, it can be seen that the rotation of the toner cartridge 14 is more insufficient as the execution count N increases. When the rotation number is within an appropriate range, the execution count also becomes an appropriate value. In the present embodiment, the appropriate value is set to 2 or less. For this reason, when the value is 3 or more, Step C is performed.

Lastly, Step C is performed. When reaching Step C, the rotation speed of the toner cartridge 14 is insufficient. For this reason, the rotation speed is increased in Step C. In the present embodiment, the rotation number is increased from a value obtained by a predetermined calculation equation.

FIG. 19 is a view illustrating an equation for calculating a duty in Step C of the third embodiment. As described above, the duty is an on/off time ratio when the on/off switching of a voltage applied to the driving source 21 is performed. In FIG. 19, Tn denotes a duty, G denotes a feedback gain, N denotes an execution count, and A denotes a threshold value. In the present embodiment, G=1, and A=2.

In the present embodiment, the initial duty T0 is set to 70%. Then, the value G(N−A) calculated by the equation of FIG. 19 is sequentially converted into the duty, and is sequentially added. Thus, the rotation number is controlled by changing the duty and increasing the voltage applied to the DC motor.

Also, the method of changing the duty is not limited to the equation of FIG. 19. The optimal equation may be used based on the discharge characteristics of the toner cartridge and the driving configuration of the toner cartridge.

By the above equation, until the determination of Step A deviates, that is, when the driving count X within the control period is from 2 to 10, the rotation speed is set to increase within an appropriate range. In the present embodiment, control is performed based on the driving count X in nine periods where the driving count X is 2 to 10. The control period may be widened or narrowed according to difference in the toner and the toner discharge characteristics of the toner cartridge.

By Step A, Step B, and Step C, when the next toner replenishment operation is performed, the rotation speed of the toner cartridge 14 in the control period is set within an appropriate range. Thus, by the variation of the rotation number of the DC motor and the variation of the load of the drive train, the toner is efficiently discharged, and the toner inside the toner cartridge 14 can be completely used without being uselessly left.

Also, after the setting within the appropriate range, without passing through Step B and Step C, the rotation of the toner cartridge 14 is executed, and when the execution count N is equal to or greater than a predetermined value (Step 9), it is determined that there is shortage of toner (Step 10). In the present embodiment, the driving count X or 10 or more fixes the rotation speed; however, the present invention is not limited thereto. For example, after the driving count X of 10, when the appropriate range of the rotation speed of the cartridge according to the driving count X is previously known, a table for changing the rotation speed according to the driving count X may be prepared for control.

In the present embodiment, when the toner sensor 17 is not turned on at the execution count N of 25 or more, it is determined that there is shortage of toner. When it is determined that the toner sensor 17 is turned off (shortage of toner), the replacement of the toner cartridge 14 is prompted through a user interface (not illustrated) provided in the image forming apparatus 60.

The user performs an operation according to the instruction and replaces the toner cartridge 14 with a new one. When the toner cartridge 14 is replaced with the new one, the rotation speed control according to the present embodiment is again performed in the same manner.

When the toner cartridge 14 is replaced, the previously set values may be continuously used. However, since various variations of the respective units may be reset as a merit of performing the control of the present embodiment, the control of the present embodiment may be performed for each toner cartridge 14.

Examples of the variations include the variation of the rotation number of the DC motors as the driving sources 21 and 22, and the variation of the power supply voltage. In addition, examples of the variations include the difference of the fluidity of the toner inside the toner cartridge 14, for example, the influence on the toner from the change of the manufacturing time and the environment in which the image forming system body is placed. Also, when the period of use increases, the loading state may be changed by the consumption of a drive train.

As described above, according to the present embodiment, a driving count X of the toner cartridge 14 necessary until the toner sensor 17 is turned on is stored, and the driving speed of the toner cartridge 14 is controlled based on the driving count X. Thus, without providing a separate sensor, the rotation speed of the toner cartridge 14 can be set within an appropriate range when the next toner replenishment operation is performed. Therefore, the toner inside the toner cartridge 14 can be efficiently consumed with an inexpensive configuration.

Also, in the present embodiment, only the execution for increasing the rotation speed is performed in Step C. The reason for this is that the appropriate range of the execution count X is 1 to 2, and it is difficult to determine whether or not the rotation speed is too high.

However, the present embodiment is not limited to increasing the rotation speed of the toner cartridge 14. For example, when the appropriate range of the execution count N is 5 or 6, or when the toner sensor 17 is turned on at a count below the appropriated range, the rotation speed may be too high. In this case, the rotation speed may be decreased. That is, control is performed such that the rotation speed of the toner cartridge 14 is changed according to the appropriate range of the execution count N. By performing control in this manner, the toner inside the toner cartridge 14 can be efficiently discharged.

Fourth Embodiment

Figure 20:
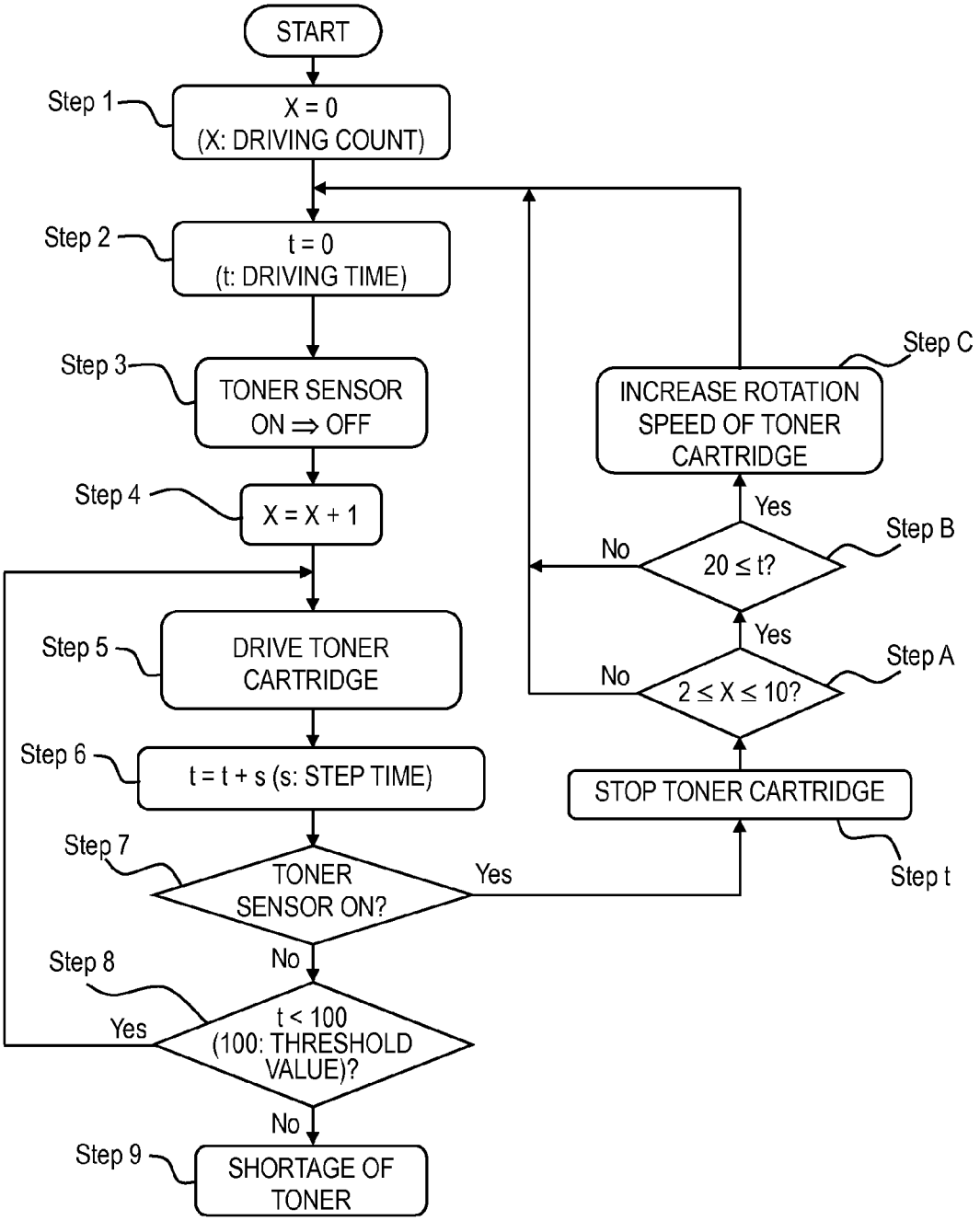
FIG. 20 is a control flow chart of the fourth embodiment.

In the third embodiment, the rotation number of the toner cartridge 14 can be controlled based on the execution count N of the toner cartridge 14. In the present embodiment, the rotation number is controlled based on the driving time of the toner cartridge 14 until the toner sensor 17 is turned on. A description will be made with reference to FIG. 20. FIG. 20 is a control flow chart of the fourth embodiment.

First, as in the third embodiment, the driving count X of the toner cartridge is reset to 0 (Step 1). Next, the driving time t is reset to 0 (Step 2). When the toner sensor 17 is turned off (Step 3), the driving count X is increased by one (Step 4).

Next, the toner cartridge 14 is driven (Step 5). Herein, after a predetermined step time s lapses (Step 6), the state of the toner sensor 17 is checked (Step 7). The step time s may be set arbitrarily. By setting the step time s to be short, the frequency of determining the state of the toner sensor 17 can be increased. In the present embodiment, S is set to 0.1 second.

When the toner sensor 17 is turned off in Step 7, the value is compared with a threshold value (Step 8). When the value is within the threshold value, the flow returns to Step 5 in order to continue driving. In the present embodiment, the threshold value of the driving time t is set to 100 seconds.

When the toner sensor is turned on in Step 7, the driving of the toner cartridge 14 is stopped (Step t). Step A, Step B, and Step C after the stopping can provide the same effect as in the first embodiment. Herein, in the present embodiment, the determination of Step B is performed based on the driving time t, and a predetermined threshold value is set to 20 seconds (driving time t≥20). That is, as the driving time t increases, the rotation speed of the toner cartridge 14 decreases. Therefore, when the next toner replenishment operation is performed, it is necessary to increase the rotation speed of the toner cartridge 14.

Lastly, when the toner sensor 17 is not turned on even when the toner cartridge 14 is driven for 100 seconds (step 8), it is determined that there is shortage of toner (Step 9). Thereafter, the replacement of the toner cartridge 14 is prompted as described above.

According to the above configuration, the toner inside the toner cartridge can be efficiently consumed, without providing a separate sensor.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-178757, filed Aug. 10, 2012 and Japanese Patent Application No. 2012-189715, filed Aug. 30, 2012, which are hereby incorporated by reference herein in their entirety.

What is claimed is:

1. A toner supply device, comprising:

a toner cartridge which contains toner;

a toner storage portion which is configured to store the toner supplied from the toner cartridge;

a toner detection sensor which is configured to detect the toner in the toner storage portion;

a conveyance member which conveys the toner in the toner storage portion;

a cartridge driving source which rotation-drives the toner cartridge; and a controller which controls a series of replenishment operations of the toner cartridge based on a detection result of the toner detection sensor;

wherein the controller controls whether to continue a series of replenishment operations of the toner cartridge based on information about driving of the conveyance member, which is acquired at predetermined periods after starting the series of replenishment operations of the toner cartridge.

2. The toner supply device according to claim 1, wherein when the replenishment operation of the conveyance member is not performed in the predetermined period, the series of replenishment operations of the toner cartridge is suspended.

3. The toner supply device according to claim 1, wherein when the series of replenishment operations of the toner cartridge is suspended, the controller resumes the series of replenishment operations of the toner cartridge when a supply operation is executed by the conveyance member.

4. The toner supply device according to claim 1, wherein when the toner detection sensor detects presence of the toner, the controller stops the series of replenishment operations of the toner cartridge.

5. The toner supply device according to claim 1, wherein when the toner detection sensor transitions from a state of detection of presence of the toner to a state of detection of shortage of the toner, the controller starts the series of replenishment operations of the toner cartridge.

6. An image forming apparatus, comprising:

an image bearing member;

a development device which performs development on the image bearing member; and the toner supply device according to claim 1, which supplies toner to the development device.

7. A toner supply device, comprising:

a toner cartridge which contains toner;

a cartridge driving source which drives the toner cartridge;

a toner storage portion which is configured to store the toner supplied from the toner cartridge;

a toner detection sensor which is configured to detect the toner in the toner storage portion; and a controller which controls a driving speed of the toner cartridge after a predetermined period based on a driving history of the toner cartridge during the predetermined period.

8. The toner supply device according to claim 7, wherein the controller controls the driving speed of the toner cartridge based on a driving time of the toner replenishment operation until the toner detection sensor detects a presence of the toner after detecting a shortage of the toner.

9. The toner supply device according to claim 7, wherein when the predetermined period has lapsed, the controller does not control the driving speed of the toner cartridge based on the driving record.

10. The toner supply device according to claim 7, wherein the driving of the toner cartridge is performed by PWM control, and a rotation number of the toner cartridge is controlled by changing a PWM control duty.

11. An image forming apparatus, comprising:

an image bearing member;

a development device which performs development on the image bearing member; and the toner supply device according to claim 7, which supplies toner to the development device.

* * * * *